US005909962A

United States Patent [19]

Livesay et al.

[11] Patent Number: 5,909,962

[45] Date of Patent: Jun. 8, 1999

[54] TIP ASSEMBLY FOR AN EDGE OF AN IMPLEMENT OF A WORK MACHINE

[75] Inventors: Richard E. Livesay, Peoria; Brent C. Bargfrede, Dunlap; John L. Bender, East Peoria; Greg O. Taylor, Peoria; Phillip W. Dawson, East Peoria, all of Ill.

[73] Assignee: Caterpillar Inc., Peoria, Ill.

[21] Appl. No.: 08/979,135

[22] Filed: Nov. 26, 1997

[51] Int. Cl.[6] ..... E02F 9/28

[52] U.S. Cl. ..... 37/456; 37/452

[58] Field of Search ..... 37/446, 452, 453, 37/454, 455, 456, 457, 458, 459; 403/150, 153, 297, 355; 299/109, 111, 113, 91–92; 172/699, 701.2, 753

[56] References Cited

U.S. PATENT DOCUMENTS

| | | | |
|---|---|---|---|
| 3,121,289 | 2/1964 | Eyolfson | 37/142 |
| 3,511,126 | 5/1970 | Watts | 85/8.3 |
| 3,520,224 | 7/1970 | Hensley et al. | 85/8.3 |
| 3,650,053 | 3/1972 | Baer | 37/142 |
| 3,774,324 | 11/1973 | Lafond | 37/142 |
| 3,952,433 | 4/1976 | Heinold et al. | 37/142 |
| 4,192,089 | 3/1980 | Schwappach | 37/142 |
| 4,446,638 | 5/1984 | Novotny et al. | 37/142 |
| 4,727,663 | 3/1988 | Hahn | 37/142 |
| 5,068,986 | 12/1991 | Jones | 37/142 |
| 5,144,762 | 9/1992 | Robinson | 37/141 |
| 5,412,885 | 5/1995 | Cornelius | 37/451 |
| 5,438,774 | 8/1995 | Fletcher et al. | 37/456 |
| 5,452,529 | 9/1995 | Neunfeldt et al. | 37/455 |
| 5,465,512 | 11/1995 | Livesay et al. | 37/457 |
| 5,469,648 | 11/1995 | Jones et al. | 37/457 |
| 5,617,655 | 4/1997 | Launder et al. | 37/457 |
| 5,638,621 | 6/1997 | Keech et al. | 37/446 |

FOREIGN PATENT DOCUMENTS

2639989 C2 4/1982 Germany .

*Primary Examiner*—Thomas B. Will
*Assistant Examiner*—Robert Pezzuto
*Attorney, Agent, or Firm*—Maginot, Addison & Moore

[57] ABSTRACT

A tip assembly for an edge of an implement of a work machine includes an adapter secured to the edge of the implement. The adapter has an adapter aperture extending therethrough. The tip assembly also includes an implement tip having a tip aperture extending therethrough, the implement tip is positioned relative to the adapter such that the adapter aperture and the tip aperture align to form a passageway. The tip assembly further includes a sleeve subassembly positioned within the passageway. The sleeve subassembly includes (i) a first member, (ii) an intermediate member, and (iii) a second member. In addition, the tip assembly includes a fastener mechanically coupled to the sleeve subassembly wherein rotation of the fastener causes (i) the intermediate member to move in a first direction, and (ii) the first and second members to move in a second direction so as to tightly secure the sleeve subassembly within the adapter aperture.

19 Claims, 4 Drawing Sheets

TIP ASSEMBLY FOR AN EDGE OF AN IMPLEMENT OF A WORK MACHINE

TECHNICAL FIELD OF THE INVENTION

The present invention relates generally to a work machine, and more particularly to a tip assembly for an edge of an implement of a work machine.

BACKGROUND OF THE INVENTION

A work machine, such as an excavator, may include a bucket for moving or excavating dirt or other types of material. A number of implement tips or teeth are attached to an edge of the bucket in order to facilitate the excavating process. The implement tips also protect the edge of the bucket from wear and tear encountered during the excavation process. Protection of the edge extends the life of the bucket and reduces maintenance cost of the work machine. However, implement tips have to be periodically replaced due to wear and tear to which they are subjected during the excavation process.

Heretofore, implement tips have been secured to a bucket by first attaching an adapter to the edge thereof and then securing the implement tip to the adapter via a pin assembly. Typically, these pin assemblies include a number of parts which contact and exert a force on both the adapter and the implement tip in order to effect the securement therebetween.

One disadvantage of having a pin assembly in contact with both the implement tip and the adapter to effect securement therebetween is that the pin assembly may become loose as the implement tip is subjected to substantial forces during a work operation. In particular, forces that are applied to the implement tip during a work operation would then be transmitted to the pin assembly. Thereafter, forces which are applied to the pin assembly would be transmitted to the adapter. Consequently, the pin assembly would be subjected to a continuous compressing force during the work operation which may cause the pin assembly to become loose within the tip assembly over a period of time.

The presence of a loose pin assembly in the tip assembly may cause inadvertent separation of the implement tip from the adapter. In addition, having the pin assembly in contact with the implement tip causes the pin assembly to wear away at a relatively fast rate. This increases the maintenance cost of operating the work machine. Furthermore, these types of pin assemblies typically include a relatively large number of parts which makes them relatively expensive, mechanically complex, and difficult to install.

What is needed therefore is a tip assembly for an edge of an implement of a work machine which overcomes one or more of the above-mentioned drawbacks.

DISCLOSURE OF THE INVENTION

In accordance with a first embodiment of the present invention, there is provided a tip assembly for an edge of an implement of a work machine. The tip assembly includes an adapter secured to the edge of the implement, wherein (i) the adapter has an adapter aperture extending therethrough, (ii) the adapter aperture defines an aperture sidewall which extends between an upper end and a lower end of the adapter aperture. The tip assembly also includes an implement tip having a tip aperture extending therethrough, the implement tip being positioned relative to the adapter such that the adapter aperture and the tip aperture align to form a passageway. The tip assembly further includes a sleeve subassembly positioned within the passageway, wherein the sleeve subassembly includes (i) a first member having a first opening extending therethrough, (ii) an intermediate member having a second opening extending therethrough, and (iii) a second member having a threaded hole defined therein, wherein the first member, the second member, and the intermediate member are positioned directly in contact with the aperture sidewall. In addition, the tip assembly includes a fastener which has a threaded portion, wherein (i) the fastener extends through the first opening in the first member and the second opening in the intermediate member, and (ii) the threaded portion of the fastener threadingly engages the threaded hole of the second member.

In accordance with a second embodiment of the present invention, there is provided a tip assembly for an edge of an implement of a work machine. The tip assembly includes an adapter secured to the edge of the implement, wherein (i) the adapter has an adapter aperture extending therethrough, (ii) the adapter aperture defines an aperture sidewall which extends between an upper end and a lower end of the adapter aperture. The tip assembly also includes an implement tip having a tip aperture extending therethrough, the implement tip being positioned relative to the adapter such that the adapter aperture and the tip aperture align to form a passageway. The tip assembly also includes a sleeve subassembly positioned within the passageway, wherein the sleeve subassembly includes (i) a first member having a first opening extending therethrough, (ii) an intermediate member having a second opening extending therethrough, and (iii) a second member having a threaded hole defined therein, wherein the first member, the second member, and the intermediate member are positioned directly in contact with the aperture sidewall. The tip assembly further includes a fastener which has a threaded portion. The fastener extends through the first opening in the first member and the second opening in the intermediate member. In addition, the threaded portion of the fastener threadingly engages the threaded hole of the second member, wherein rotation of the fastener while the threaded portion of the fastener is threadingly engaged with the threaded hole of the second member causes (i) the intermediate member to move in a first direction, and (ii) the first and second members to move in a second direction, wherein the first direction is different from the second direction.

In accordance with a third embodiment, there is provided a fastening assembly for securing an implement tip to an adapter which is mounted on an edge of an implement of a work machine, with (i) the adapter having an adapter aperture extending therethrough, (ii) the adapter aperture defining an aperture sidewall which extends between an upper end and a lower end of the adapter aperture, (iii) the implement tip having a tip aperture extending therethrough, and (iv) the implement tip being positioned relative to the adapter such that the adapter aperture and the tip aperture align to form a passageway. The fastening assembly includes a sleeve subassembly positioned within the passageway, wherein the sleeve subassembly includes (i) a first member having a first opening extending therethrough, (ii) an intermediate member having a second opening extending therethrough, and (iii) a second member having a threaded hole defined therein, wherein the first member, the second member, and the intermediate member are each positionable directly in contact with the aperture sidewall. The fastening assembly further includes a fastener which includes a threaded portion, wherein (i) the fastener extends through the first opening in the first member and the second opening in the intermediate member, and (ii) the threaded portion of the fastener threadingly engages the threaded hole of the second member, wherein (i) the intermediate member possesses a sloped top end, (ii) the first member possesses a sloped bottom end which is shaped complementary to the sloped top end, (iii) the intermediate member possesses a sloped lower end, and (iv) the second member possesses a sloped upper end which is shaped complementary to the sloped lower end.

BEST MODE FOR CARRYING OUT THE INVENTION

Figure 1:
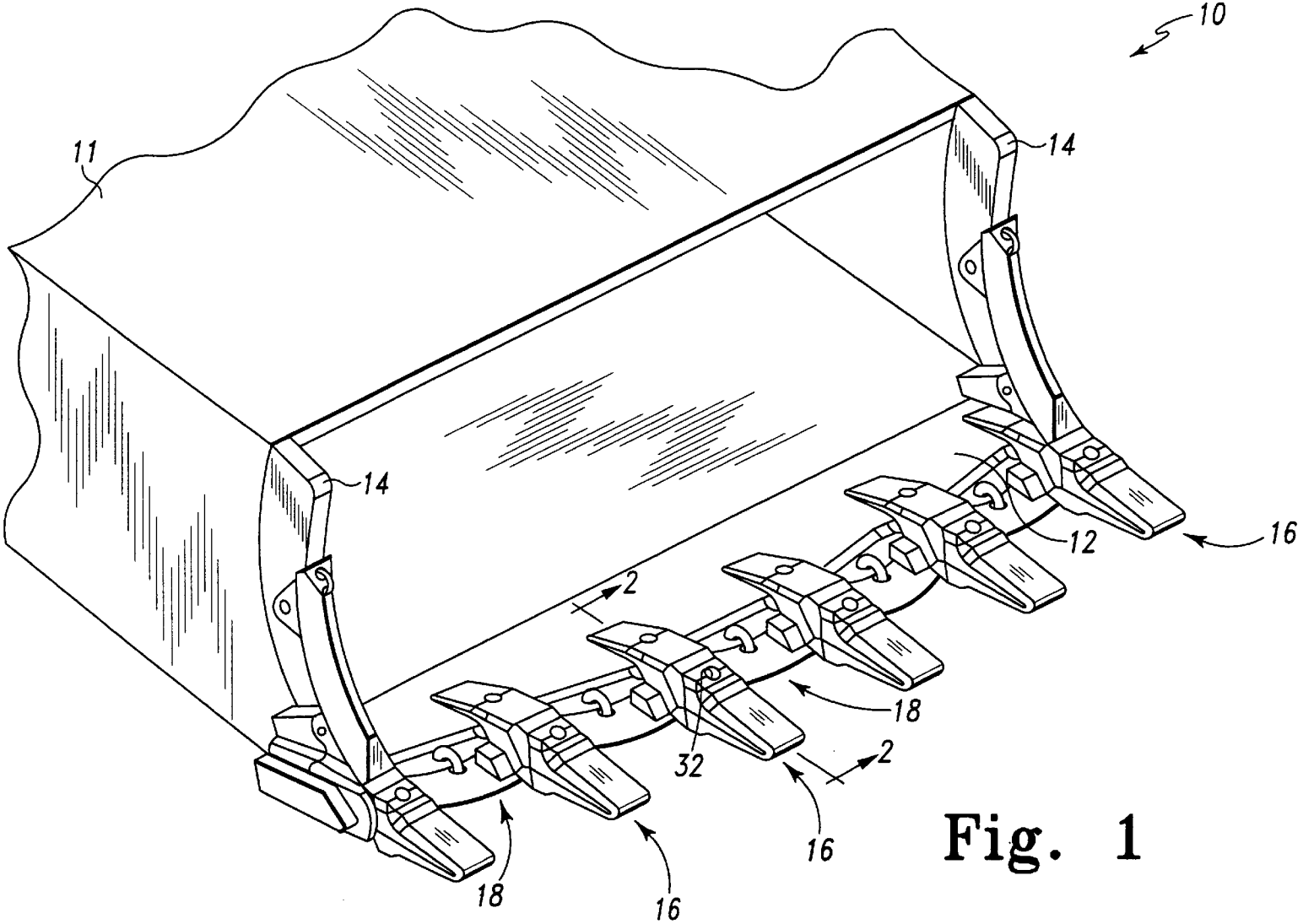
FIG. 1 is a fragmentary perspective view of a bucket assembly of a work machine having a number of tip assemblies attached thereto each which incorporates the features of the present invention therein.

While the invention is susceptible to various modifications and alternative forms, a specific embodiment thereof has been shown by way of example in the drawings and will herein be described in detail. It should be understood, however, that there is no intent to limit the invention to the particular form disclosed, but on the contrary, the intention is to cover all modifications, equivalents, and alternatives falling within the spirit and scope of the invention as defined by the appended claims.

Referring now to FIG. 1, there is shown an implement, such as a metallic bucket assembly 10, which incorporates the features of the present therein. The bucket assembly 10 includes a bucket 11 which is partially shown in FIG. 1. The bucket 11 is used on a work machine, such as an excavator (not shown), to excavate material in a known manner. Bucket assembly 10 includes an edge 12, two support arms 14, and a number of tip assemblies 16 attached to edge 12. Bucket assembly 10 also includes a number of edge protector assemblies 18 interposed between tip assemblies 16, and secured to edge 12.

Figure 2:
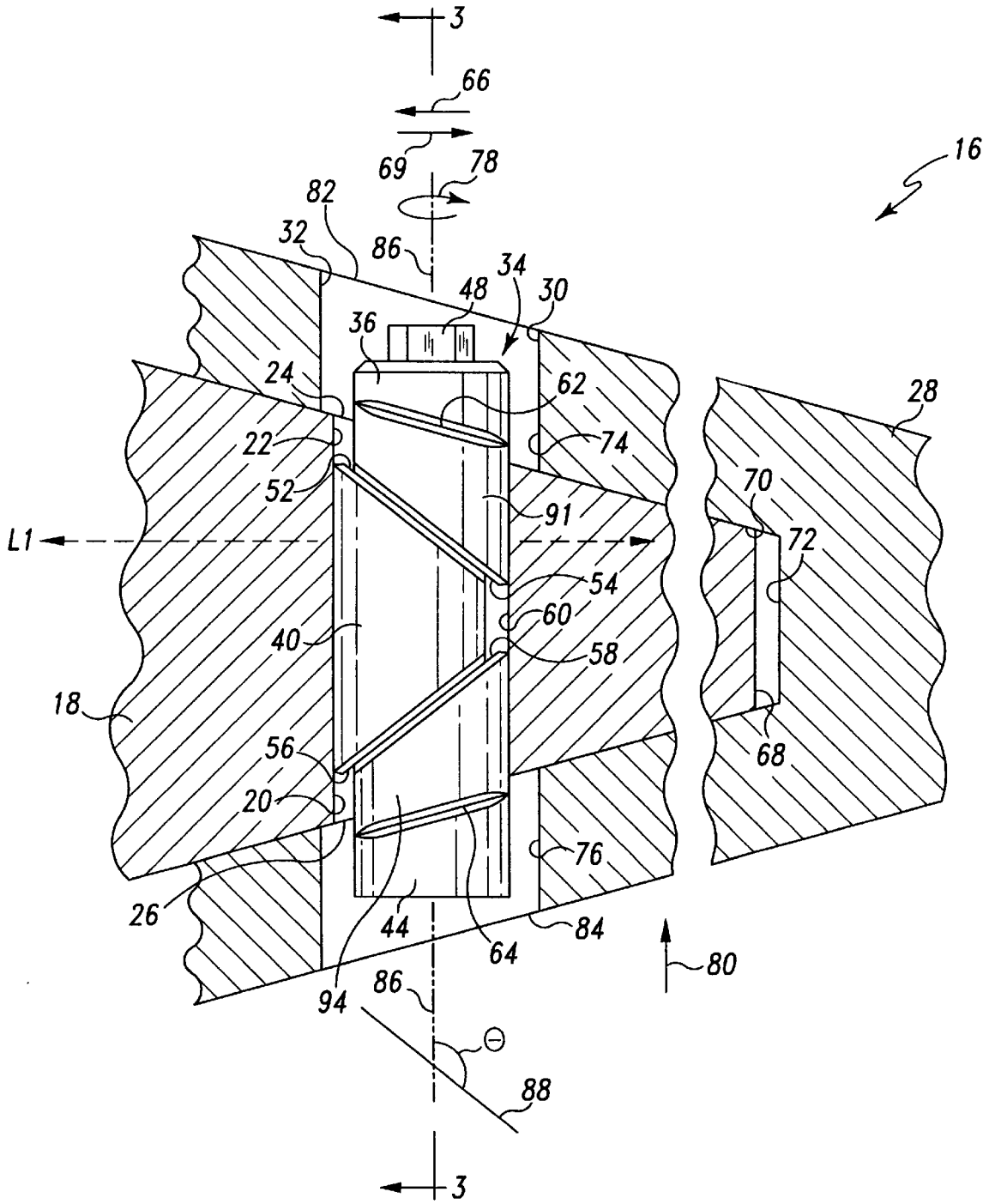
FIG. 2 is an enlarged fragmentary cross sectional view of a tip assembly taken along line 2—2 of FIG. 1 as viewed in the direction of the arrows (note that the sleeve subassembly and the fastener of the tip assembly are not shown in cross section for clarity of description)

As shown in FIG. 2, each tip assembly 16 includes an adapter 18, an implement tip 28, a sleeve subassembly 34, and a fastener 48 having a threaded portion 50 (see FIG. 3) defined thereon. Adapter 18 has an adapter aperture 20 extending therethrough. A cross section taken through adapter aperture 20 at line L1 defines an oval shape (i.e. an interior surface of adapter aperture 20 is oval shaped). Adapter aperture 20 defines an aperture sidewall 22. Aperture sidewall 22 extends between an upper end 24 and a lower end 26 of adapter aperture 20. Aperture sidewall 22 defines a contact segment 60. In addition, adapter 18 includes a central leading exterior wall segment 68.

Implement tip 28 includes a tip aperture 30 extending therethrough. Tip aperture 30 defines an upper lateral leading wall segment 74 and a lower lateral leading wall segment 76. In addition, implement tip 28 defines an adapter cavity 70. The adapter cavity 70 defines a leading interior wall segment 72 positioned within adapter cavity 70.

Figure 3:
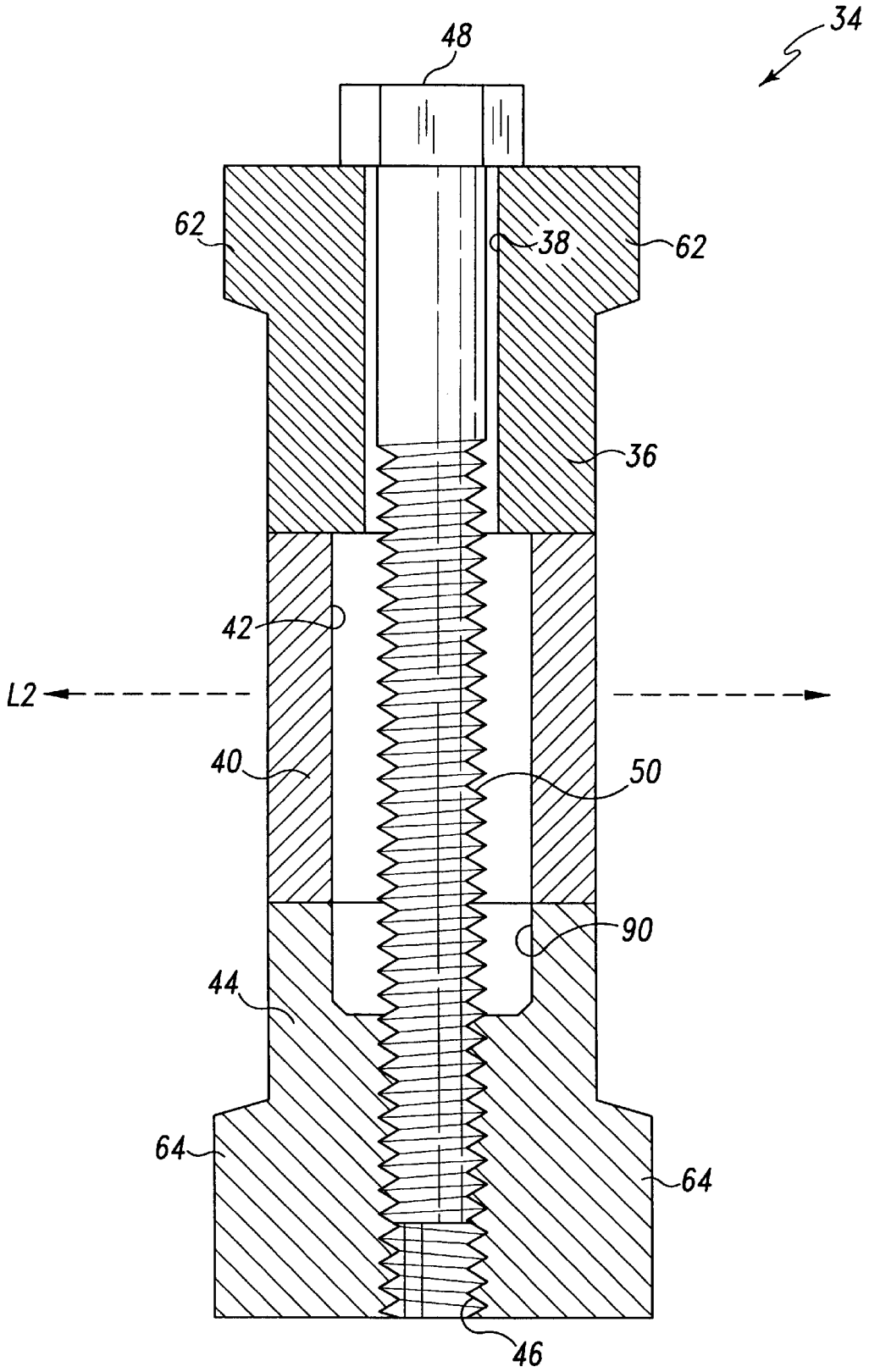
FIG. 3 is an enlarged cross sectional view of the sleeve subassembly taken along line 3—3 of FIG. 2 as viewed in the direction of the arrows, with the fastener shown positioned within the sleeve subassembly and the implement tip and adapter shown removed for clarity of description.
Figure 4:
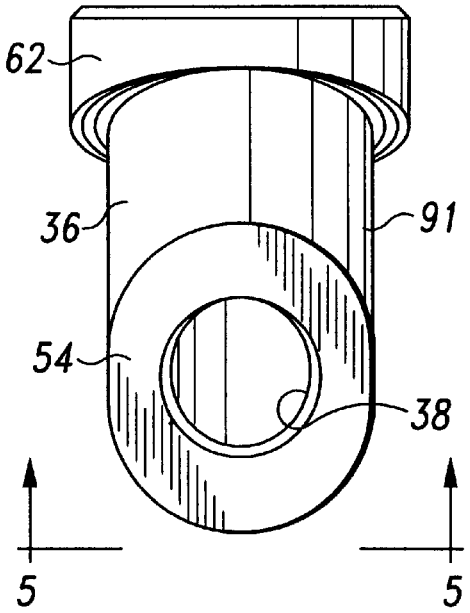
FIG. 4 is a side elevational view of the first member of the sleeve subassembly shown in FIG. 2.
Figure 5:
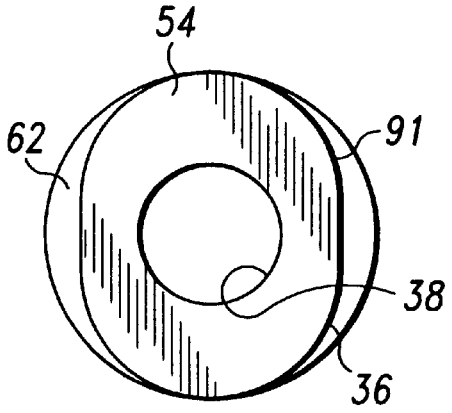
FIG. 5 is an end elevational view of the first member taken along line 5—5 of FIG. 4 as viewed in the direction of the arrows.
Figure 6:
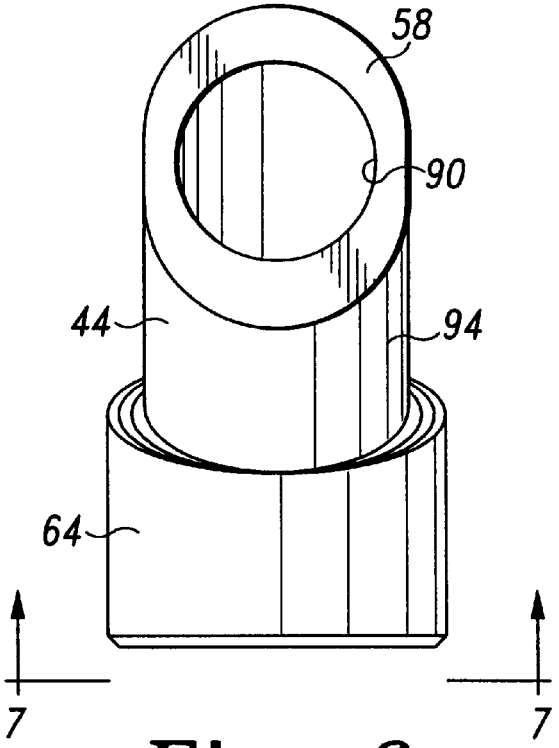
FIG. 6 is a side elevational view of the second member of the sleeve subassembly shown in FIG. 2.
Figure 7:
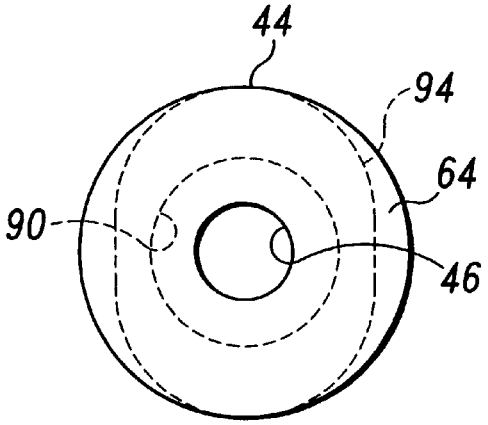
FIG. 7 is an end elevational view of the second member taken along line 7—7 of FIG. 6 as viewed in the direction of the arrows.

Sleeve subassembly 34 includes a first member 36, an intermediate member 40, and a second member 44. As shown in FIGS. 3, 4, and 5, first member 36 includes a first opening 38 extending therethrough, and an upper securement portion 62 extending therefrom. First member 36 also includes a sloped bottom end 54 and an oval-shaped portion 91. As shown in FIGS. 3, 6, and 7, second member 44 includes a threaded hole 46 and a subcavity 90 defined therein. Second member 44 also includes a lower securement portion 64 extending therefrom. In addition, second member 44 includes a sloped upper end 58 and an oval-shaped portion 94.

As shown in FIGS. 2 and 3, intermediate member 40 possesses a second opening 42 extending therethrough. A cross section taken through intermediate member 40 at line L2 defines two oval surfaces. In particular, the inner surface of intermediate member 40 which defines the second opening 42 possesses an oval shape. Thus, the second opening 42 possesses an oval shape. Moreover, the outer surface of intermediate member 40 defines an oval shape. Since the outer surface of intermediate member 40 possesses an oval shape, the intermediate member is somewhat inhibited from rotating in the directions indicated by arrows 66 and 69 when the intermediate member is located within oval-shaped adapter aperture 20. This is especially beneficial when fastener 48 is tightened or loosened within sleeve subassembly 34 during a maintenance procedure.

Intermediate member 40 also has a sloped top end 52, and a sloped lower end 56. It should be understood that sloped bottom end 54 of first member 36 is shaped complementary to sloped top end 52 of intermediate member 40 (see FIG. 2). It should also be understood that sloped upper end 58 of second member 44 is shaped complementary to sloped lower end 56 of intermediate member 40 (see FIG. 2).

Referring now to FIG. 2, what is meant herein by "sloped" top end 52 is that a line 88 drawn parallel to a plane (not shown) defined by sloped top end 52 of intermediate member 40 will intersect central axis 86 of adapter aperture 20 so as to define an angle $\Theta$ which does not equal 90° when sleeve subassembly 34 is positioned within adapter aperture 20. This meaning of the term "sloped" also applies to "sloped" lower end 56, "sloped" bottom end 54, and "sloped" upper end 58. That is, (i) a line drawn parallel to a plane defined by sloped lower end 56, (ii) a line drawn parallel to a plane defined by sloped bottom end 54, and (iii) a line drawn parallel to a plane defined by sloped upper end 58 will each intersect central axis 86 of adapter aperture 20 so as to define an angle which does not equal 90° when sleeve subassembly 34 is positioned in adapter aperture 20.

Implement tip 28 is positioned relative to adapter 18 such that adapter aperture 20 and tip aperture 30 align to form a passageway 32. In addition, implement tip 28 is positioned relative to adapter 18 such that adapter 18 extends into adapter cavity 70, and leading interior wall segment 72 is spaced apart from central leading exterior wall segment 68.

After adapter aperture 20 and tip aperture 30 have been aligned to form passageway 32 as described above, sleeve subassembly 34 is preferably positioned within passageway 32 in the following manner. First, sloped upper end 58 of second member 44 is inserted upwardly through lower end 26 of adapter aperture 20 and held in place by a technician's hand (not shown). Intermediate member 40 is then inserted downwardly through upper end 24 of adapter aperture 20 so that sloped lower end 56 of intermediate member 40 contacts slopped upper end 58 of second member 44. First member 36 is then inserted downwardly through upper end 24 of adapter aperture 20 so that slopped bottom end 54 of first member 36 contacts sloped top end 52 of intermediate member 40. Locating first member 36, intermediate member 40, and second member 44 in the above described manner positions oval-shaped portion 91 of first member 36, intermediate member 40, and oval-shaped portion 94 of second member 44 in direct contact with aperture sidewall 22. It should be appreciated that the aforementioned oval shaped interior surface of adapter aperture 20 is substantially complementary to the shape of oval-shaped portion 91 of first member 36, oval-shaped portion 94 of second member 44, and the oval-shaped exterior surface of intermediate member 40 such that the aforementioned elements nest within adapter aperture 20. Having oval shaped portion 94 of second member 44 nested within the oval shaped adapter aperture 20 prevents second member 44 from rotating relative to adapter 18 upon rotation of fastener 48, thus facilitating installation (and removal) of sleeve subassembly 34 within (and from) adapter aperture 20.

As shown in FIG. 3, locating first member 36, intermediate member 40, and second member 44 in the above described manner also aligns first opening 38 of first member 36, second opening 42 of intermediate member 40, and threaded hole 46 of second member 44. Fastener 48 is then positioned relative to sleeve subassembly 34 such that fastener 48 extends through first opening 38 in first member 36 and through second opening 42 in intermediate member 40. Fastener 48 is further positioned relative to sleeve subassembly 34 such that threaded portion 50 threadingly engages threaded hole 46 of second member 44.

Now referring back to FIG. 2, when threaded portion 50 of fastener 48 is threadingly engaged with threaded hole 46, and sleeve subassembly 34 is positioned in passageway 32, the following is true: (i) the leading portion of adapter 18 is interference fit into the adapter cavity 70, (ii) first member 36 is spaced apart from upper lateral leading wall segment 74 of implement tip 28, and (iii) second member 44 is spaced apart from lower lateral leading wall segment 76 of implement tip 28.

The space defined between (i) first member 36 and upper lateral leading wall segment 74 and (ii) second member 44 and lower lateral leading wall segment 76 are each maintained during the use of bucket assembly 10 even after implement tip 28 and adapter 18 have worn a significant amount. This is true since, as implement tip 28 and adapter 18 wear away during use, implement tip 28 may move relative to adapter 18 in the direction indicated by arrow 66 such that leading interior wall segment 72 contacts central leading exterior wall segment 68. Having leading interior wall segment 72 in contact with central leading exterior wall segment 68 substantially limits the distance implement tip 28 can move relative to adapter 18 in the direction indicated by arrow 66 and thus maintains the space between (i) first member 36 and upper lateral leading wall segment 74 and (ii) second member 44 and lower lateral leading wall segment 76. Having space maintained between (i) first member 36 and upper lateral leading wall segment 74 and (ii) second member 44 and lower lateral leading wall segment 76 during use of bucket assembly 10 is an advantage of the present invention since it reduces the wear and tear on sleeve subassembly 34.

Once sleeve subassembly 34 and fastener 48 are assembled in the above described manner, rotation of fastener 48 relative to sleeve subassembly 34 in a direction indicated by arrow 78 causes second member 44 to move relative to adapter 18 in a direction indicated by arrow 80. Movement of second member 44 in the direction indicated by arrow 80 urges intermediate member 40 against aperture sidewall 22 in a direction indicated by arrow 66. The above described urging of intermediate member 40 in the direction indicated by arrow 66 causes first member 36 and second member 44 to be urged against contact segment 60 in an opposite direction as indicated by arrow 69. Urging intermediate member 40 in the direction indicated by arrow 66 while urging first member 36 and second member 44 in the direction indicated by arrow 69 tightly secures sleeve subassembly 34 within adapter aperture 20. Having sleeve subassembly 34 tightly secured within adapter aperture 20 reduces the likelihood that implement tip 28 will become inadvertently separated from adapter 18.

It should be appreciated that sleeve subassembly 34 is designed to be a relatively less complex mechanism which is secured within adapter aperture 20 as compared to sleeve subassemblies of other tip assemblies. For example, some sleeve subassemblies use a spool or a bearing member interposed between a sleeve member and the adapter aperture sidewall or contact segment to effect securement of the implement tip to the adapter. These additional parts, i.e. the spool or bearing member, must be carefully located in an appropriate position relative to one another during installation which causes these tip assemblies to be difficult to install as compared to the present invention. In addition, these additional parts increase the mechanical complexity, and thus the expense, of these tip assemblies.

Moreover, it should be appreciated that having sleeve subassembly 34 tightly secured within adapter aperture 20 in the above described manner positions sleeve subassembly 34 completely within passageway 32. That is, no portion of sleeve subassembly 34 extends beyond ends 82 and 84 of passageway 32 as shown in FIG. 2. Having sleeve subassembly 34 positioned in this manner reduces the wear to which sleeve subassembly 34 is subjected during use of bucket assembly 10. Thus, the useful life of sleeve subassembly 34 is extended which reduces the maintenance costs of operating the work machine. This is particularly true with regard to intermediate member 40 which is substantially isolated from wear during operation of the work machine. Therefore, intermediate member 40 can be reused many times which further reduces maintenance cost of operating the work machine.

In addition, it should be understood that having sleeve subassembly 34 tightly secured within adapter aperture 20 so that sleeve subassembly 34 is substantially fixed in relation to adapter 18 reduces the wear on aperture side wall 22 as compared to other sleeve subassemblies. For example, some sleeve subassemblies tend to move within the adapter aperture during use and thus wear away the aperture side wall. Wearing away of the aperture side wall can increase the likelihood that the sleeve subassembly will become loose in the adapter aperture.

Industrial Applicability

The implement tip 28 facilitates the excavation process and shields adapter 18 and edge 12 from contact with the material being excavated during use of the bucket assembly 10. Therefore, implement tip 28 is subjected to the major portion of the wear and tear resulting from the excavation process. It should be appreciated that implement tip 28 is attached to adapter 18 by having sleeve subassembly 34 secured within adapter aperture 20. In addition, it should be appreciated that no surface of implement tip 28 is utilized to effect securement of sleeve subassembly 34 within adapter aperture 20. This is an important aspect of the present invention since direct contact between implement tip 28 and a sleeve subassembly would allow forces to be transmitted directly from the implement tip 28 to the sleeve subassembly during a work operation thereby substantially contributing to loosening of the sleeve subassembly in the adapter aperture 20. This loosening can result in inadvertent separation of the implement tip 28 from adapter 18.

The likelihood that sleeve subassembly 34 becomes loose within the adapter aperture 20 is reduced with the present invention since the occasions during which the implement tip 28 contacts sleeve subassembly 34 during a work operation is reduced. Thus, sleeve subassembly 34 remains tightly secured within adapter aperture 20, thereby maintaining the attachment of implement tip 28 to adapter 18.

Once implement tip 28 is worn to a point where it must be replaced, sleeve subassembly 34 is removed from adapter aperture 20 by first rotating fastener 48 relative to sleeve subassembly 34 in a direction opposite to the direction indicated by arrow 78 shown in FIG. 2. Rotating fastener 48 in the above described manner causes threaded portion 50 of fastener 48 to disengage threaded hole 46 of second member 44 (see FIG. 3). Disengaging threaded portion 50 in the above described manner causes sleeve subassembly 34 to no longer be tightly secured within adapter aperture 20. Fastener 48 is then withdrawn from first opening 38 in first member 36 (see FIG. 3), second opening 42 in intermediate member 40 (see FIG. 3), and passageway 32 (see FIG. 2). Sleeve subassembly 34 is then removed from passageway 32 (see FIG. 2). Once sleeve subassembly 34 is removed from passageway 32, implement tip 28 is removed from adapter 18 and a replacement implement tip 18 may be positioned on adapter 18 and secured thereto with sleeve subassembly 34 and fastener 48 as previously described.

While the invention has been illustrated and described in detail in the drawings and foregoing description, such illustration and description is to be considered as exemplary and not restrictive in character, it being understood that only the preferred embodiment has been shown and described and that all changes and modifications that come within the spirit of the invention are desired to be protected.

What is claimed is:

1. A tip assembly for an edge of an implement of a work machine, comprising:

an adapter secured to said edge of said implement, wherein (i) said adapter has an adapter aperture extending therethrough, (ii) said adapter aperture defines an aperture sidewall which extends between an upper end and a lower end of said adapter aperture;

an implement tip having a tip aperture extending therethrough, said implement tip being positioned relative to said adapter such that said adapter aperture and said tip aperture align to form a passageway;

a sleeve subassembly positioned within said passageway, wherein said sleeve subassembly includes (i) a first member having a first opening extending therethrough, (ii) an intermediate member having a second opening extending therethrough, and (iii) a second member having a threaded hole defined therein, wherein said first member, said second member, and said intermediate member are each positioned directly in contact with said aperture sidewall; and a fastener which includes a threaded portion, wherein (i) said fastener extends through said first opening in said first member and said second opening in said intermediate member, and (ii) said threaded portion of said fastener threadingly engages said threaded hole of said second member.

2. The tip assembly of claim 1, wherein:

said intermediate member possesses a sloped top end; and said first member possesses a sloped bottom end which is shaped complementary to said sloped top end.

3. The tip assembly of claim 2, wherein:

said intermediate member possesses a sloped lower end; and said second member possesses a sloped upper end which is shaped complementary to said sloped lower end.

4. The tip assembly of claim 1, wherein:

said adapter includes a contact segment, said first member includes an upper securement portion extending therefrom, said second member includes a lower securement portion extending therefrom, and said contact segment is positioned between said upper securement portion and said lower securement portion when said threaded portion of said fastener is threadingly engaged with said threaded hole of said second member.

5. The tip assembly of claim 3, wherein:

rotation of said fastener while said threaded portion of said fastener is threadingly engaged with said threaded hole of said second member causes (i) said intermediate member to move in a first direction, and (ii) said first and second members to move in a second direction, and said first direction is different from said second direction.

6. The tip assembly of claim 1, wherein:

said adapter has a central leading exterior wall segment, said implement tip defines an adapter cavity into which said adapter extends, said implement tip further defines a leading interior wall segment positioned within said adapter cavity, and said central leading exterior wall segment is positioned in contact with said leading interior wall segment.

7. The tip assembly of claim 6, wherein:

said tip further has an upper lateral leading wall segment and a lower lateral leading wall segment, said first member is spaced apart from said upper lateral leading wall segment, and said second member is spaced apart from said lower lateral leading wall segment.

8. The tip assembly of claim 1, wherein:

said adapter aperture possesses an oval shape, said first member includes a first oval-shaped portion positioned within said adapter aperture, and said second member includes a second oval-shaped portion positioned within said adapter aperture.

9. The tip assembly of claim 8, wherein:

an outer surface of said intermediate member defines an oval shape.

10. A tip assembly for an edge of an implement of a work machine, comprising:

an adapter secured to said edge of said implement, wherein (i) said adapter has an adapter aperture extending therethrough, (ii) said adapter aperture defines an aperture sidewall which extends between an upper end and a lower end of said adapter aperture;

an implement tip having a tip aperture extending therethrough, said implement tip being positioned relative to said adapter such that said adapter aperture and said tip aperture align to form a passageway;

a sleeve subassembly positioned within said passageway, wherein said sleeve subassembly includes (i) a first member having a first opening extending therethrough, (ii) an intermediate member having a second opening extending therethrough, and (iii) a second member having a threaded hole defined therein, wherein said first member, said second member, and said intermediate member are each positioned directly in contact with said aperture sidewall; and a fastener which includes a threaded portion, said fastener extending through said first opening in said first member and said second opening in said intermediate member, and said threaded portion of said fastener threadingly engages said threaded hole of said second member, wherein rotation of said fastener while said threaded portion of said fastener is threadingly engaged with said threaded hole of said second member causes (i) said intermediate member to move in a first direction, and (ii) said first and second members to move in a second direction, and said first direction is different from said second direction.

11. The tip assembly of claim 10, wherein:

said intermediate member possesses a sloped top end and a sloped lower end;

said first member possesses a sloped bottom end which is shaped complementary to said sloped top end; and said second member possesses a sloped upper end which is shaped complementary to said sloped lower end.

12. The tip assembly of claim 10, wherein:

said adapter includes a contact segment, said first member includes an upper securement portion extending therefrom, said second member includes a lower securement portion extending therefrom, and said contact segment is positioned between said upper securement portion and said lower securement portion when said threaded portion of said fastener is threadingly engaged with said threaded hole of said second member.

13. The tip assembly of claim 10, wherein:

said first member includes an upper securement portion extending therefrom, said second member includes a lower securement portion extending therefrom, said tip further has an upper lateral leading wall segment and a lower lateral leading wall segment, said upper securement portion is spaced apart from said upper lateral leading wall segment, and said lower securement portion is spaced apart from said lower lateral leading wall segment.

14. The tip assembly of claim 10, wherein:

said adapter aperture possesses an oval shape, said first member includes a first oval-shaped portion positioned within said adapter aperture, and said second member includes a second oval-shaped portion positioned within said adapter aperture.

15. The tip assembly of claim 14, wherein:

an outer surface of said intermediate member defines an oval shape.

16. A fastening assembly for securing an implement tip to an adapter which is mounted on an edge of an implement of a work machine, with (i) said adapter having an adapter aperture extending therethrough, (ii) said adapter aperture defining an aperture sidewall which extends between an upper end and a lower end of said adapter aperture, (iii) said implement tip having a tip aperture extending therethrough, and (iv) said implement tip being positioned relative to said adapter such that said adapter aperture and said tip aperture align to form a passageway, comprising:

a sleeve subassembly positioned within said passageway, wherein said sleeve subassembly includes (i) a first member having a first opening extending therethrough, (ii) an intermediate member having a second opening extending therethrough, and (iii) a second member having a threaded hole defined therein, wherein said first member, said second member, and said intermediate member are each positionable directly in contact with said aperture sidewall; and a fastener which includes a threaded portion, wherein (i) said fastener extends through said first opening in said first member and said second opening in said intermediate member, and (ii) said threaded portion of said fastener threadingly engages said threaded hole of said second member, wherein (i) said intermediate member possesses a sloped top end, (ii) said first member possesses a sloped bottom end which is shaped complementary to said sloped top end, (iii) said intermediate member possesses a sloped lower end, and (iv) said second member possesses a sloped upper end which is shaped complementary to said sloped lower end.

17. The fastening assembly of claim 16, wherein:

rotation of said fastener while said threaded portion of said fastener is threadingly engaged with said threaded hole of said second member causes (i) said intermediate member to move in a first direction, and (ii) said first and second members to move in a second direction, and said first direction is different from said second direction.

18. The fastening assembly of claim 16, wherein:

said adapter aperture possesses an oval shape, said first member includes a first oval-shaped portion positionable within said adapter aperture, and said second member includes a second oval-shaped portion positionable within said adapter aperture.

19. The fastening assembly of claim 18, wherein:

an outer surface of said intermediate member defines an oval shape.

* * * * *